US008302582B2

(12) United States Patent
Oohashi et al.

(10) Patent No.: US 8,302,582 B2
(45) Date of Patent: Nov. 6, 2012

(54) FUEL SUPPLY DEVICE

(75) Inventors: Masaharu Oohashi, Takahama (JP); Toshihiko Muramatsu, Chiryu (JP)

(73) Assignee: Denso Corporation, Kariya (JP)

( * ) Notice: Subject to any disclaimer, the term of this patent is extended or adjusted under 35 U.S.C. 154(b) by 196 days.

(21) Appl. No.: 12/974,324

(22) Filed: Dec. 21, 2010

(65) Prior Publication Data

US 2011/0146627 A1 Jun. 23, 2011

(30) Foreign Application Priority Data

Dec. 23, 2009 (JP) ..... 2009-291598

(51) Int. Cl.
*F02M 57/02* (2006.01)
*F02M 69/04* (2006.01)
*F02M 37/04* (2006.01)

(52) U.S. Cl. ..... 123/446; 123/457; 123/497

(58) Field of Classification Search ..... 123/446, 123/447, 457, 458, 497, 510, 511, 514
See application file for complete search history.

(56) References Cited

U.S. PATENT DOCUMENTS

| | | | | |
|---|---|---|---|---|
| 5,967,119 | A * | 10/1999 | Burkhard et al. | 123/458 |
| 6,536,415 | B2 * | 3/2003 | Joos et al. | 123/497 |
| 6,971,373 | B2 * | 12/2005 | Mudway et al. | 123/497 |
| 7,114,490 | B2 * | 10/2006 | Zdroik | 123/497 |
| 7,392,794 | B2 * | 7/2008 | Hazama | 123/497 |
| 7,458,362 | B2 | 12/2008 | Hazama et al. | |
| 7,559,310 | B2 * | 7/2009 | Yahata | 123/446 |
| 8,171,916 | B2 * | 5/2012 | Nishibu et al. | 123/458 |
| 8,230,841 | B2 * | 7/2012 | Okada et al. | 123/511 |
| 2005/0155582 | A1 * | 7/2005 | Schelhas et al. | 123/497 |
| 2007/0227511 | A1 | 10/2007 | Hazama et al. | |
| 2011/0011373 | A1 | 1/2011 | Shimura et al. | |

FOREIGN PATENT DOCUMENTS

| | | |
|---|---|---|
| JP | P2007-263032 A | 10/2007 |
| JP | 4320969 | 6/2009 |
| JP | P2009-235960 A | 10/2009 |
| JP | P2009-264367 A | 11/2009 |

* cited by examiner

*Primary Examiner* — Thomas Moulis
(74) *Attorney, Agent, or Firm* — Nixon & Vanderhye PC

(57) ABSTRACT

A fuel supply device includes a relief valve, a pressure regulator, and a controller. The controller controls a first pump to send fuel into an engine through a first passage, and controls a second pump to send fuel into a second passage to communicate with the first passage. The relief valve discharges fuel from the second passage when a fuel pressure of the second passage is higher than a relief pressure. The pressure regulator discharges fuel when a fuel pressure of fuel chamber is higher than a regulation pressure higher than the relief pressure in a state that a fuel pressure of backpressure chamber is equal to the relief pressure.

6 Claims, 8 Drawing Sheets

FUEL SUPPLY DEVICE

CROSS REFERENCE TO RELATED APPLICATION

This application is based on Japanese Patent Application No. 2009-291598 filed on Dec. 23, 2009, the disclosure of which is incorporated herein by reference in its entirety.

BACKGROUND OF THE INVENTION

1. Field of the Invention

The present invention relates to a fuel supply device.

2. Description of Related Art

A fuel supply device has an electric pump to supply fuel to an internal combustion engine. A pressure of the supplied fuel is controlled based on operation state of the engine so as to reduce fuel consumption of the engine. For example, when the engine has an idling operation, the pressure of the supplied fuel is lowered so as to reduce power consumption of the pump. In contrast, when the engine has a high-load operation, or when the engine is started, the pressure of the supplied fuel is raised so as to increase an output amount of the engine. Thus, fuel mileage can be improved.

JP-A-2007-263032 discloses a fuel supply device using a pair of electric pumps. Specifically, the fuel supply device includes a primary pump, a backpressure control pump, and a pressure regulator. The pressure regulator has a fuel chamber and a backpressure chamber. The fuel chamber communicates with a passage to which the primary pump supplies fuel. The backpressure chamber communicates with a passage to which the backpressure control pump supplies fuel.

When a fuel pressure in the fuel chamber becomes higher than a regulation pressure corresponding to a fuel pressure in the backpressure chamber, fuel is discharged out of the fuel chamber. The fuel pressure in the fuel chamber is controlled to have the regulation pressure, and fuel having the fuel pressure is supplied to the engine.

A pressure of fuel supplied to the engine is set by a valve-opening pressure corresponding to the fuel pressure in the backpressure chamber. The fuel pressure in the backpressure chamber depends on a pressure of fuel discharged out of the backpressure control pump. Therefore, the discharge pressure of the backpressure control pump is required to be accurately controlled so as to accurately control the pressure of fuel supplied to the engine. However, the discharge pressure of the backpressure control pump is easily changed by disturbance such as a voltage variation of a power source to supply electric power to the backpressure control pump. JP-A-2007-263032 fails to disclose a control method to cancel the change of the fuel pressure.

SUMMARY OF THE INVENTION

In view of the foregoing and other problems, it is an object of the present invention to provide a fuel supply device.

According to an example of the present invention, a fuel supply device to supply fuel to an engine includes a fuel passage portion, a first electric pump, a second electric pump, a relief valve, a pressure regulator, and a controller. The fuel passage portion has a first passage to send supply fuel to the engine, and a second passage to communicate with the first passage. The first electric pump sends fuel into the first passage, and the second electric pump sends fuel into the second passage. The relief valve discharges fuel out of the second passage when a fuel pressure of the second passage becomes higher than a predetermined relief pressure. The pressure regulator has a fuel chamber to communicate with the first passage, and a backpressure chamber to communicate with the second passage. The pressure regulator discharges fuel out of the fuel chamber when a fuel pressure of the fuel chamber becomes higher than a regulation pressure set higher than the relief pressure in a state that a fuel pressure of the backpressure chamber is equal to the relief pressure. The controller switches control mode of the first pump and the second pump between a low pressure mode and a high pressure mode based on an operation state of the engine. The controller controls the first pump to stop, and controls a pressure of fuel discharged from the second pump to become higher than the relief pressure, when the low pressure mode is selected. The controller controls a pressure of fuel discharged from the first pump to become higher than the regulation pressure, and controls a pressure of fuel discharged from the second pump to become higher than the relief pressure, when the high pressure mode is selected.

Accordingly, the pressure of fuel supplied to the engine can be accurately controlled based on the operation state of the engine.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

Figure 1:
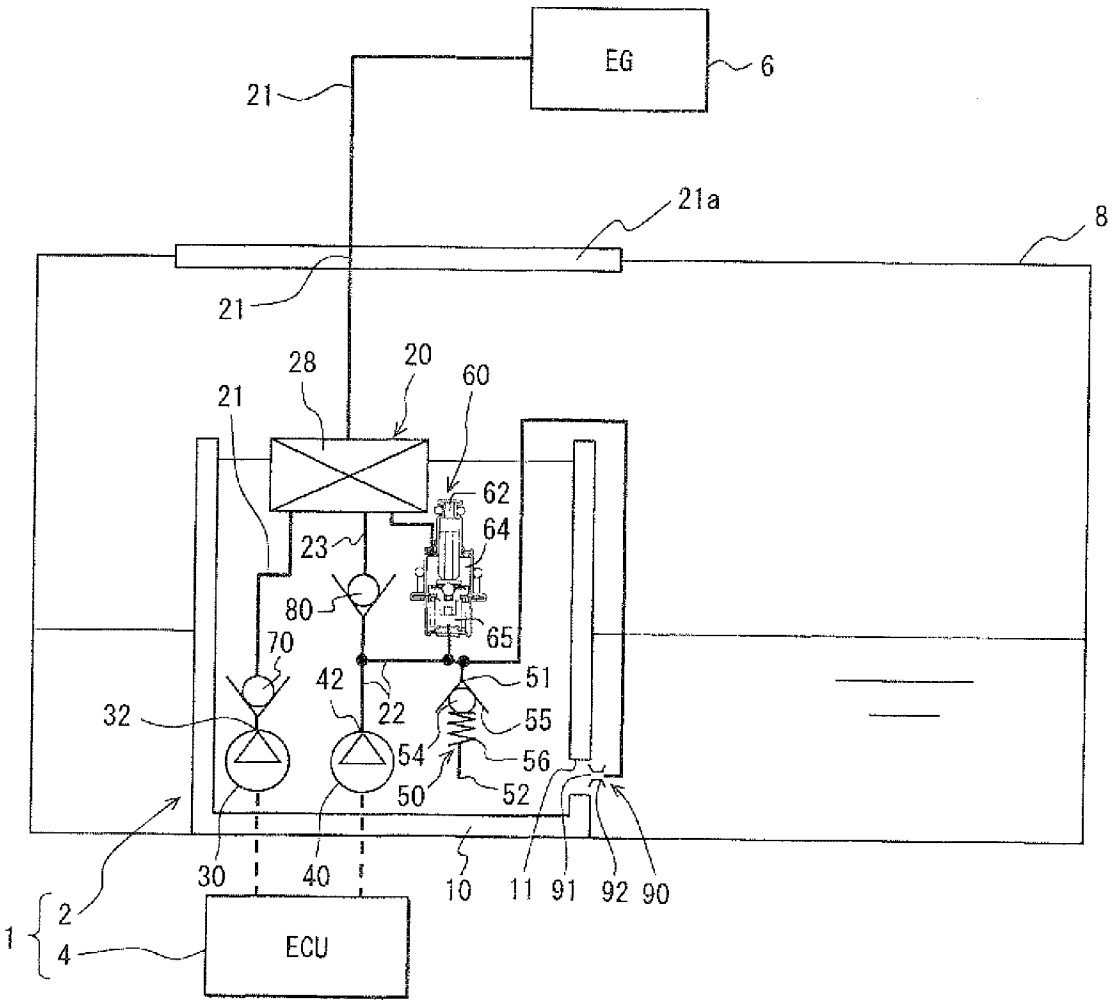
FIG. 1 is a schematic view illustrating a fuel supply device according to a first embodiment.

A fuel supply device 1 will be described with reference to FIG. 1. The fuel supply device 1 includes a pump unit 2 and a control unit 4 corresponding to an electronic control unit (ECU). Fuel is supplied to an internal combustion engine 6 of a vehicle by controlling the pump unit 2 through the control unit 4.

The pump unit 2 is mounted in a fuel tank 8 storing fuel to be supplied to the engine 6. The pump unit 2 has a reservoir cup 10, a fuel passage portion 20, first and second electric pumps 30, 40, a relief valve 50, a pressure regulator 60, first and second check valves 70, 80, and a jet pump 90.

The reservoir cup 10 has a based-cylinder shape, and is arranged in the fuel tank 8. The reservoir cup corresponds to a sub-tank disposed inside of the fuel tank 8. A circumference wall of the cup 10 has a through hole 11 passing through the wall. The reservoir cup 10 stores fuel flowing from the fuel tank 8 through the through hole 11.

The fuel passage portion 20 has a first passage 21, a second passage 22, and a branch passage 23. The first passage 21 is a main passage for sending fuel corresponding to supply fuel from the reservoir cup 10 to the engine 6. A fuel filter 28 is arranged in the first passage 21, and filters the supply fuel flowing through the passage 21. For example, the first passage 21 is defined by a passage member (not shown), a lid member 21*a*, and a pipe member (not shown). The passage member is fixed to the cup 10. The lid member 21*a* closes an opening of the fuel tank 8 through which the pump unit 2 is inserted into the tank 8. A fuel injection valve of the engine 6 is mounted to the pipe member outside of the fuel tank 8.

The second passage 22 communicates with the first passage 21 through the branch passage 23, so as to send the supply fuel from the cup 10 into the engine 6. The branch passage 23 is branched from the second passage 22, and communicates with an upstream section of the fuel filter 28. The supply fuel flowing from the second passage 22 is also filtered by the filter 28. A downstream side of the second passage 22 extends to outside of the cup 10, and fuel is sent to adjacency of the through hole 11 of the cup 10. The second passage 22 and the branch passage 23 are made of approximately the same passage member as the first passage 21, for example.

The first electric pump 30 is disposed inside of the reservoir cup 10, and has a suction port (not shown) to be open inside of the cup 10. In contrast, a discharge port 32 of the first pump 30 communicates with an upstream end of the first passage 21. The first pump 30 suctions fuel stored in the cup 10 through the suction port, and a pressure of fuel is raised by the pump 30. The fuel having the raised pressure is discharged out of the discharge port 32 into the first passage 21. The first pump 30 is a centrifugal pump to raise a pressure of the suctioned fuel, by rotating an impeller using a direct-current motor with a brush. The pressure of fuel discharged into the first passage 21 is controlled by controlling electricity supplied to the motor.

The second electric pump 40 is disposed inside of the reservoir cup 10, and has a suction port (not shown) to be open inside of the cup 10. In contrast, a discharge port 42 of the second pump 40 communicates with an upstream end of the second passage 22. The second pump 40 suctions fuel stored in the cup 10 through the suction port, and a pressure of fuel is raised by the pump 40. The fuel having the raised pressure is discharged out of the discharge port 42 into the second passage 22. The second pump 40 is a centrifugal pump to raise a pressure of the suctioned fuel, by rotating an impeller using a brushless direct-current motor. The pressure of fuel discharged into the second passage 22 is controlled by controlling electricity supplied to the motor. The motor of the second pump 40 has low output and low power consumption compared with the motor of the first pump 30. Therefore, the second pump 40 has the maximum discharge amount such as 30 L/hour, which is smaller than that of the first pump 30 such as 80-150 L/hour.

The relief valve 50 is disposed inside of the reservoir cup 10. An inlet port 51 of the relief valve 50 communicates with the second passage 22, and is located downstream of a branch position at which the branch passage 23 is branched from the second passage 22. A discharge port 52 of the relief valve 50 is open to inside of the cup 10.

The relief valve 50 has a valve member 54, a valve seat 55 and an elastic member 56. The valve member 54 is arranged to seat on or separate from the valve seat 55. When the valve member 54 receives a pressure force from fuel flowing through the second passage 22, the valve member 54 is moved by the force in a direction separating from the valve seat 55.

In contrast, when the valve member 54 receives a restoring force of the elastic member 56, the valve member 54 is moved in a direction seating on the valve seat 55. When a valve-opening pressure of the relief valve 50 is fixed into a predetermined relief pressure Prl, the relief valve 50 has the following operation.

Before a fuel pressure of the second passage 22 becomes higher than the relief pressure Prl, the valve member 54 is seated on the valve seat 55, such that the relief valve 50 is closed by the restoring force of the elastic member 56. At this time, because communication between the inlet port 51 and the discharge port 52 is blocked, fuel flowing through the second passage 22 is not discharged into the reservoir cup 10 through the relief valve 50.

In contrast, when the fuel pressure of the second passage 22 becomes higher than the relief pressure Prl, the relief valve 50 is opened. That is, the valve member 54 is separated from the valve seat 55 against the restoring force of the elastic member 56. At this time, the inlet port 51 and the discharge port 52 communicate with each other, and fuel flowing through the second passage 22 is discharged into the reservoir cup 10 through the relief valve 50. Therefore, the fuel pressure of the second passage 22 is mechanically controlled to have the relief pressure Prl.

Figure 2:
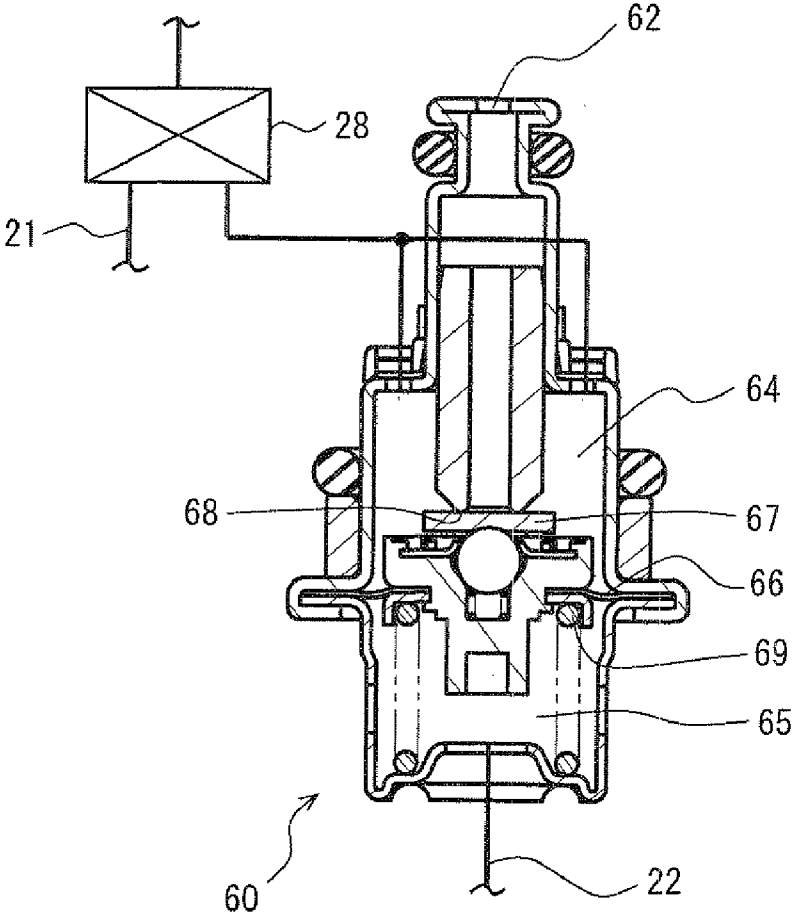
FIG. 2 is an enlarged cross-sectional view illustrating a pressure regulator of the fuel supply device.

The pressure regulator 60 is disposed inside of the reservoir cup 10, and a discharge port 62 of the regulator 60 is open to inside of the cup 10. As shown in FIG. 2, the pressure regulator 60 has a fuel chamber 64, a backpressure chamber 65, a diaphragm 66, a valve member 67, a valve seat 68, and an elastic member 69.

The fuel chamber 64 communicates with an upstream section of the fuel filter 28 arranged in the first passage 21. The backpressure chamber 65 is arranged in the second passage 22. The backpressure chamber 65 is located downstream of the branch point of the branch passage 23, and is located upstream of a communication point of the relief valve 50.

The diaphragm 66 has flexibility, and liquid-tightly separates the fuel chamber 64 from the backpressure chamber 65 together with the valve member 67. The valve member 67 is fixed to the diaphragm 66, and is seated on or separated from the valve seat 68. When the valve member 67 receives pressure force from fuel in the fuel chamber 64, the valve member 67 is moved in a direction separating from the valve seat 68.

In contrast, when the valve member 67 receives pressure force from fuel in the backpressure chamber 65 and the restoring force of the elastic member 69, the valve member 67 is moved in a direction seating on the valve seat 68. A pressure of fuel in the backpressure chamber 65 corresponds to a backpressure. When a valve-opening pressure of the pressure regulator 60 is changed in accordance with the backpressure of the backpressure chamber 65, the pressure regulator 60 has the following operation.

When the backpressure of the backpressure chamber 65 is equal to the relief pressure Prl of the relief valve 50, the valve-opening pressure of the pressure regulator 60 corresponds to a high regulation pressure Prg_h set higher than the relief pressure Prl. Therefore, in a state where the backpressure of the backpressure chamber 65 is equal to the relief pressure Prl, before the fuel pressure of the fuel chamber 64 becomes higher than the high regulation pressure Prg_h, the valve member 67 is seated on the valve seat 68 by the backpressure force and the restoring force of the elastic member 69. That is, at this time, the pressure regulator 60 is closed, and communication between the fuel chamber 64 and the discharge port 62 is stopped, thereby fuel is not discharged out of the fuel chamber 64 into the reservoir cup 10 through the pressure regulator 60.

In contrast, when the fuel pressure of the fuel chamber 64 becomes higher than the high regulation pressure Prg_h, the valve member 67 is separated from the valve seat 68 against the backpressure force and the restoring force of the elastic member 69, while the back pressure of the backpressure chamber 65 is equal to the relief pressure Prl. That is, at this time, the pressure regulator 60 is opened, and the communication between the fuel chamber 64 and the discharge port 62 is allowed, thereby fuel is discharged out of the fuel chamber 64 into the reservoir cup 10 through the pressure regulator 60. Thus, the fuel pressure of the fuel chamber 64 is mechanically adjusted to have the high regulation pressure Prg_h.

In a case where the backpressure of the backpressure chamber 65 is equal to atmospheric pressure Pa lower than the relief pressure Prl of the relief valve 50, the valve-opening pressure of the pressure regulator 60 corresponds to a low regulation pressure Prg_l set lower than the high regulation pressure Prg_h, while the valve-opening pressure of the pressure regulator 60 is higher than the relief pressure Prl. Therefore, in a state where the backpressure of the backpressure chamber 65 is equal to the atmospheric pressure Pa, before the fuel pressure of the fuel chamber 64 becomes higher than the low regulation pressure Prg_l, the valve member 67 is seated on the valve seat 68 by the restoring force of the elastic member 69. That is, at this time, the pressure regulator 60 is closed, and the communication between the fuel chamber 64 and the discharge port 62 is stopped, thereby fuel is not discharged out of the fuel chamber 64 into the reservoir cup 10 through the pressure regulator 60.

In contrast, when the fuel pressure of the fuel chamber 64 becomes higher than the low regulation pressure Prg_l, the valve member 67 is separated from the valve seat 68 against the restoring force of the elastic member 69, while the backpressure of the backpressure chamber 65 is equal to the atmospheric pressure Pa. That is, at this time, the pressure regulator 60 is opened, and the communication between the fuel chamber 64 and the discharge port 62 is allowed, thereby fuel is discharged out of the fuel chamber 64 into the reservoir cup 10 through the pressure regulator 60. Thus, the fuel pressure of the fuel chamber 64 is mechanically adjusted to have the low regulation pressure Prg_l.

As shown in FIG. 1, the first check valve 70 is arranged in the first passage 21, and is located downstream of the first pump 30 and located upstream of the fuel filter 28.

When an upstream fuel pressure defined between the first pump 30 and the first check valve 70 is higher than a downstream fuel pressure defined between the fuel filter 28 and the first check valve 70, and when a difference between the upstream fuel pressure and the downstream fuel pressure is equal to or larger than a first threshold $\Delta P1$, the valve 70 is opened. That is, the first check valve 70 is opened when the two conditions are satisfied. In contrast, the valve 70 is closed if at least one of the two conditions is not satisfied.

The second check valve 80 is arranged in the branch passage 23, and is located between the fuel filter 28 of the first passage 21 and the second passage 22.

When an upstream fuel pressure defined between the second passage 22 and the second check valve 80 is higher than a downstream fuel pressure defined between the first passage 21 and the second check valve 80, and when a difference between the upstream fuel pressure and the downstream fuel pressure is equal to or larger than a second threshold $\Delta P2$, the valve 80 is opened. The valve 80 is closed until the above two conditions are satisfied. If the fuel pressure in the first passage 21 becomes higher than the fuel pressure in the second passage 22, the valve 80 is closed, and the first passage 21 is disconnected from the second passage 22. In contrast, the second check valve 80 is opened when the above valve-opening conditions are satisfied.

The jet pump 90 is disposed outside of the cup 10, and is located at a downstream end of the second passage 22. The jet pump 90 has an injection port 91 open toward the through hole 11 of the cup 10. The jet pump 90 defines a throttle 92 to decrease a communication area of the second passage 22. A speed of fuel reaching the downstream end of the second passage 22 is made faster by the throttle 92, and the jet pump 90 makes the fuel to be injected toward the through hole 11 from the injection port 91. A negative pressure is generated in the through hole 11 by the fuel injection, and fuel stored in the fuel tank 8 is drawn into the cup 10 through the through hole 11.

The control unit 4 is mainly constructed by a microcomputer, for example, and is operated in response to electric power supplied from a battery corresponding to a power source of the vehicle. The control unit 4 is electrically connected to the electric pump 30, 40, and controls electricity supply state for the electric pump 30, 40. The control unit 4 controls the pump 30, 40 by switching a control mode among, for example, three modes based on operation state of the engine 6. For example, the control mode is set among a low pressure mode, a high pressure mode and a middle pressure mode.

(Low Pressure Mode)

Figure 3:
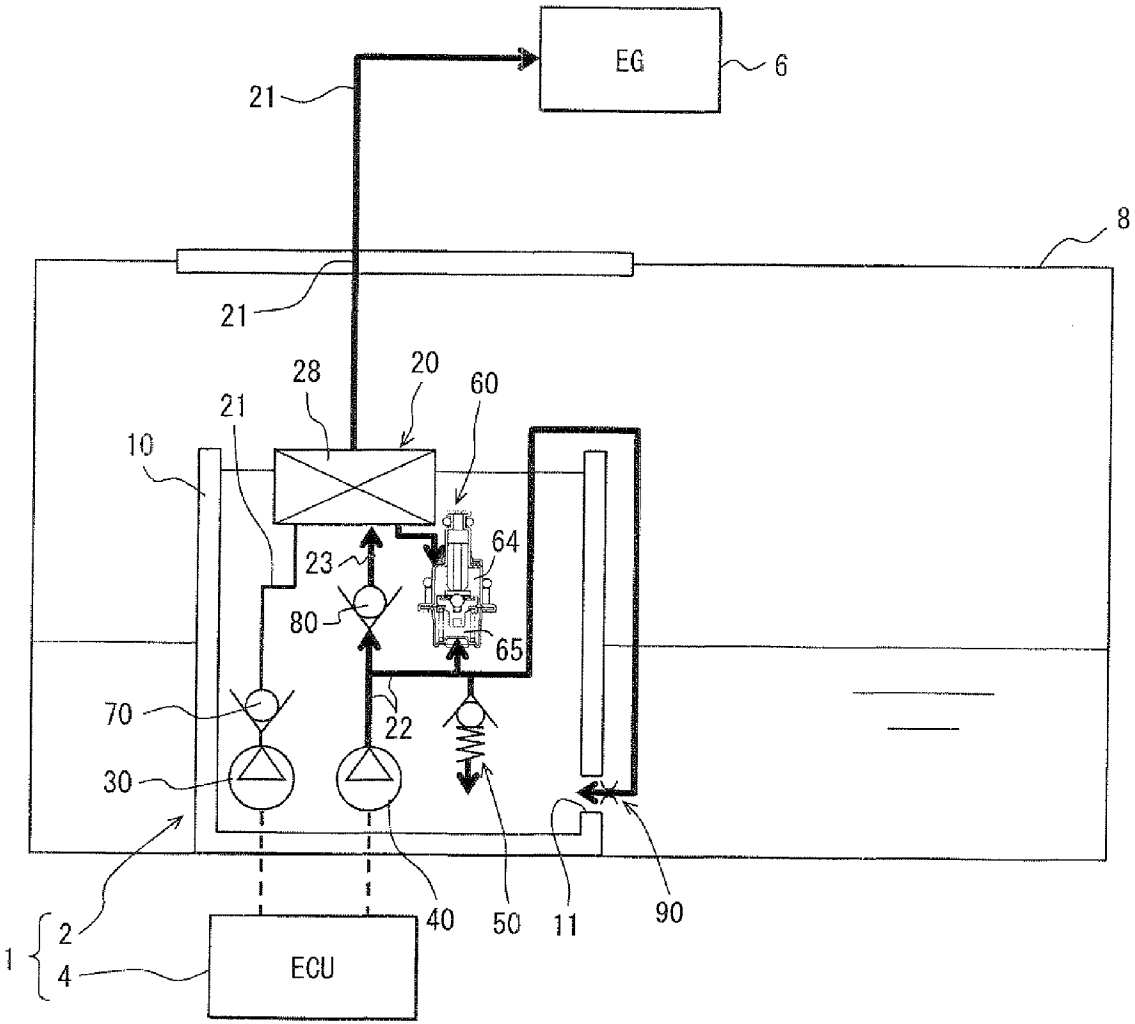
FIG. 3 is a schematic view illustrating a low pressure mode of the fuel supply device.

A low pressure mode is selected by the control unit 4 when the engine 6 has no load at an idling time, for example. As shown in FIG. 3, at the low pressure mode, the control unit 4 stops the first pump 30 from discharging fuel into the first passage 21 by stopping electricity supply to the pump 30. Further, the control unit 4 controls voltage or current applied to the second pump 40 discharging fuel into the second passage 22. Therefore, the pressure of fuel discharged from the second pump 40 is made higher than the relief pressure Prl, and is made lower than both of the regulation pressures Prg_h and Prg_l.

In the low pressure mode, if the fuel pressure of the second passage 22 becomes higher than the relief pressure Prl in accordance with the pressure of fuel discharged from the second pump 40, the relief valve 50 discharges fuel from the second passage 22 into the reservoir cup 10, as shown in FIG. 3. Therefore, the fuel pressure of the second passage 22 can be accurately controlled into the relief pressure Prl without being affected by accuracy for controlling the pressure of fuel discharged from the second pump 40.

Further, at this time, a fuel pressure of the branch passage 23 adjacent to the second passage 22 becomes higher than a fuel pressure of the branch passage 23 adjacent to the first passage 21, and a difference between the fuel pressures becomes equal to the second threshold $\Delta P2$ of the second check valve 80. That is, the valve-opening conditions of the second check valve 80 are satisfied.

The second passage 22 communicates not only with the backpressure chamber 65 but also with the first passage 21. Therefore, the fuel pressures of the backpressure chamber 65 and the first passage 21 become equal to the relief pressure Prl adjusted by the relief valve 50. In this case, the fuel pressure of the fuel chamber 64 communicating with the first passage 21 does not exceed the high regulation pressure Prg_h higher than the relief pressure Prl. Therefore, the pressure regulator 60 does not discharge fuel from the fuel chamber 64 into the reservoir cup 10. Thus, the correctly-adjusted relief pressure Prl will be given to the supply fuel supplied to the engine 6 by the first passage 21.

Further, in the low pressure mode, fuel is discharged from the second pump 40 into the second passage 22, as shown in the bold line arrow of FIG. 3. The discharged fuel is injected from the jet pump 90, thereby fuel stored in the fuel tank 8 is transported into the reservoir cup 10 through the through hole 11. Therefore, fuel to be suctioned by the second pump 40 can be restricted from being shorted inside of the cup 10. That is, the pressure of fuel discharged from the second pump 40 can be restricted from becoming lower than the relief pressure Prl Thus, due to the relief valve 50 and the pressure regulator 60, the fuel pressure of the passage 21, 22 can be properly controlled. Accordingly, the relief pressure Prl can be accurately secured as a pressure of the supply fuel in the low pressure mode.

(High Pressure Mode)

Figure 4:
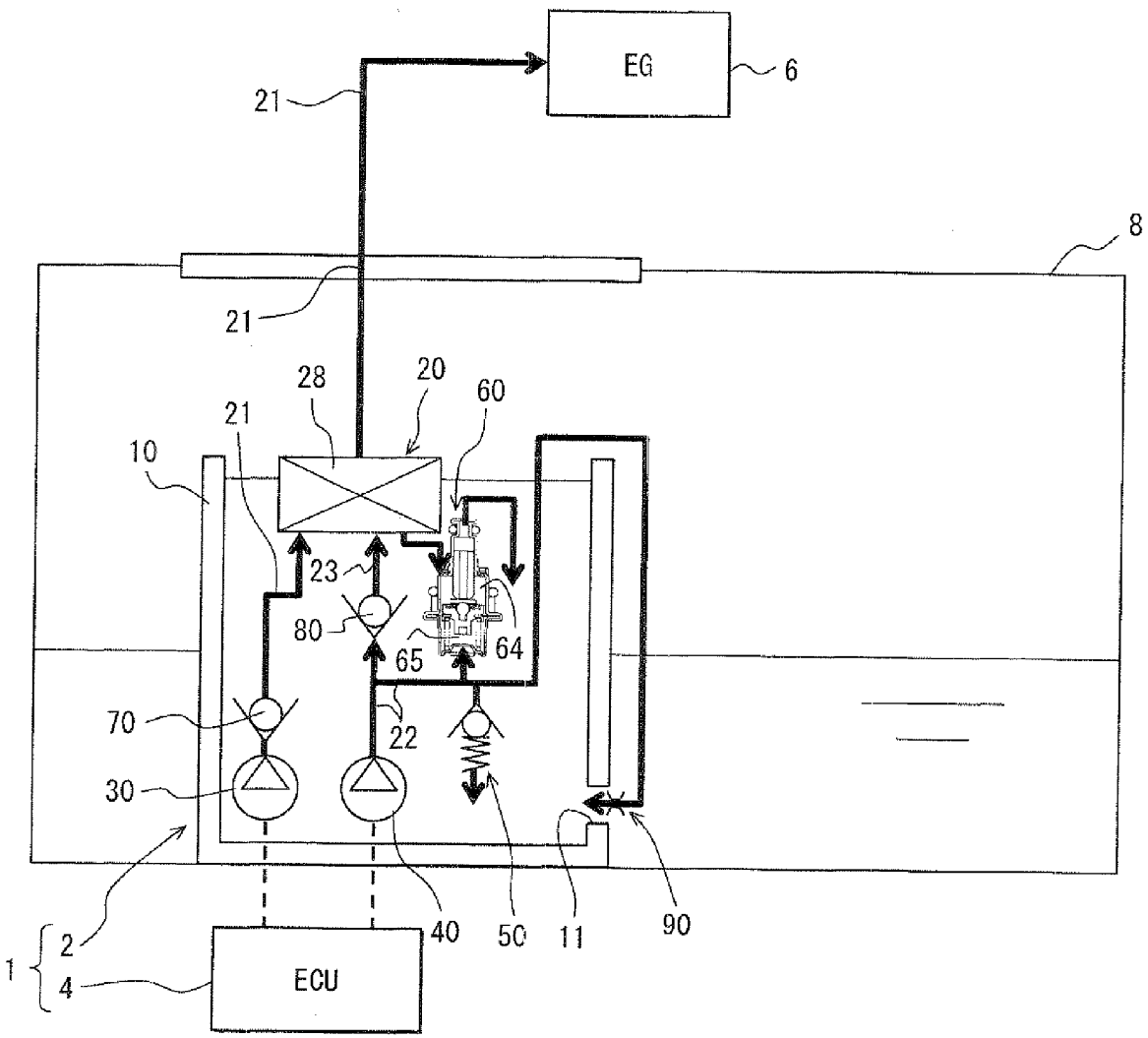
FIG. 4 is a schematic view illustrating a high pressure mode of the fuel supply device.

A high pressure mode is selected by the control unit 4 when the engine 6 has high load or at a start time of the engine 6. As shown in FIG. 4, in the high pressure mode, the control unit 4 controls voltage or current applied to the first pump 30 discharging fuel into the first passage 21. Therefore, the pressure of fuel discharged from the first pump 30 is made higher than all of the relief pressure Prl and the regulation pressures Prg_h and Prg_l.

Further, the control unit 4 controls voltage or current applied to the second pump 40 discharging fuel into the second passage 22. The pressure of fuel discharged from the second pump 40 is made higher than the relief pressure Prl, and is made lower than both of the regulation pressures Prg_h and Prg_l.

In the high pressure mode, the pressure of fuel discharged from the second pump 40 is flexibly controllable, if the pressure is higher than the pressure Prl, and if the pressure is lower than the pressures Prg_h and Prg_l. In this embodiment, for example, the pressure of fuel discharged from the second pump 40 is controlled to have approximately the same pressure as that in the low pressure mode.

In the high pressure mode, if the fuel pressure of the second passage 22 becomes higher than the relief pressure Prl in accordance with the pressure of fuel discharged from the second pump 40, the relief valve 50 discharges fuel from the second passage 22 into the reservoir cup 10, as shown in a bold line arrow of FIG. 4. Therefore, the fuel pressure of the second passage 22 can be accurately controlled into the relief pressure Prl without being affected by accuracy for controlling the pressure of fuel discharged from the second pump 40.

Further, the first check valve 70 is opened in the first passage 21 by the pressure of fuel discharged from the first pump 30. As a result, a fuel pressure of the branch passage 23 adjacent to the first passage 21 becomes higher than a fuel pressure of the branch passage 23 adjacent to the second passage 22. Therefore, the first passage 21 is disconnected from the second passage 22, because the valve-opening conditions of the second check valve 80 are not satisfied.

The backpressure of the backpressure chamber 65 communicating with the second passage 22 is equal to the relief pressure Prl adjusted by the relief valve 50. In contrast, the fuel pressure of the first passage 21 disconnected from the second passage 22 becomes higher than the high regulation pressure Prg_h, due to the pressure of fuel discharged from the first pump 30. In this case, the fuel pressure of the fuel chamber 64 communicating with the first passage 21 becomes higher than the high regulation pressure Prg_h. Therefore, the pressure regulator 60 discharges fuel from the fuel chamber 64 into the reservoir cup 10, as shown in the bold line arrow of FIG. 4.

The fuel pressures of the fuel chamber 64 and the first passage 21 can be accurately controlled into the high regulation pressure Prg_h without being affected by accuracy for controlling the pressure of fuel discharged from the first pump 30. Thus, the high regulation pressure Prg_h correctly adjusted to be higher than the relief pressure Prl of the low pressure mode is given to the supply fuel supplied to the engine 6 by the first passage 21.

Further, in the high pressure mode, fuel is discharged from the second pump 40 into the second passage 22, as shown in the bold line arrow of FIG. 4, and the discharged fuel is injected from the jet pump 90, thereby fuel stored in the fuel tank 8 is transported into the reservoir cup 10 through the through hole 11. Therefore, fuel to be suctioned by the pump 30, 40 can be restricted from being shorted inside of the cup 10. That is, the pressure of fuel discharged from the pump 30 can be restricted from becoming lower than the pressure Prg_h, and the pressure of fuel discharged from the pump 40 can be restricted from becoming lower than the pressure Prl.

Thus, due to the relief valve 50 and the pressure regulator 60, the fuel pressure of the passage 21, 22 can be properly controlled. Accordingly, the high regulation pressure Prg_h can be accurately secured as a pressure of the supply fuel in the high pressure mode.

(Middle Pressure Mode)

Figure 5:
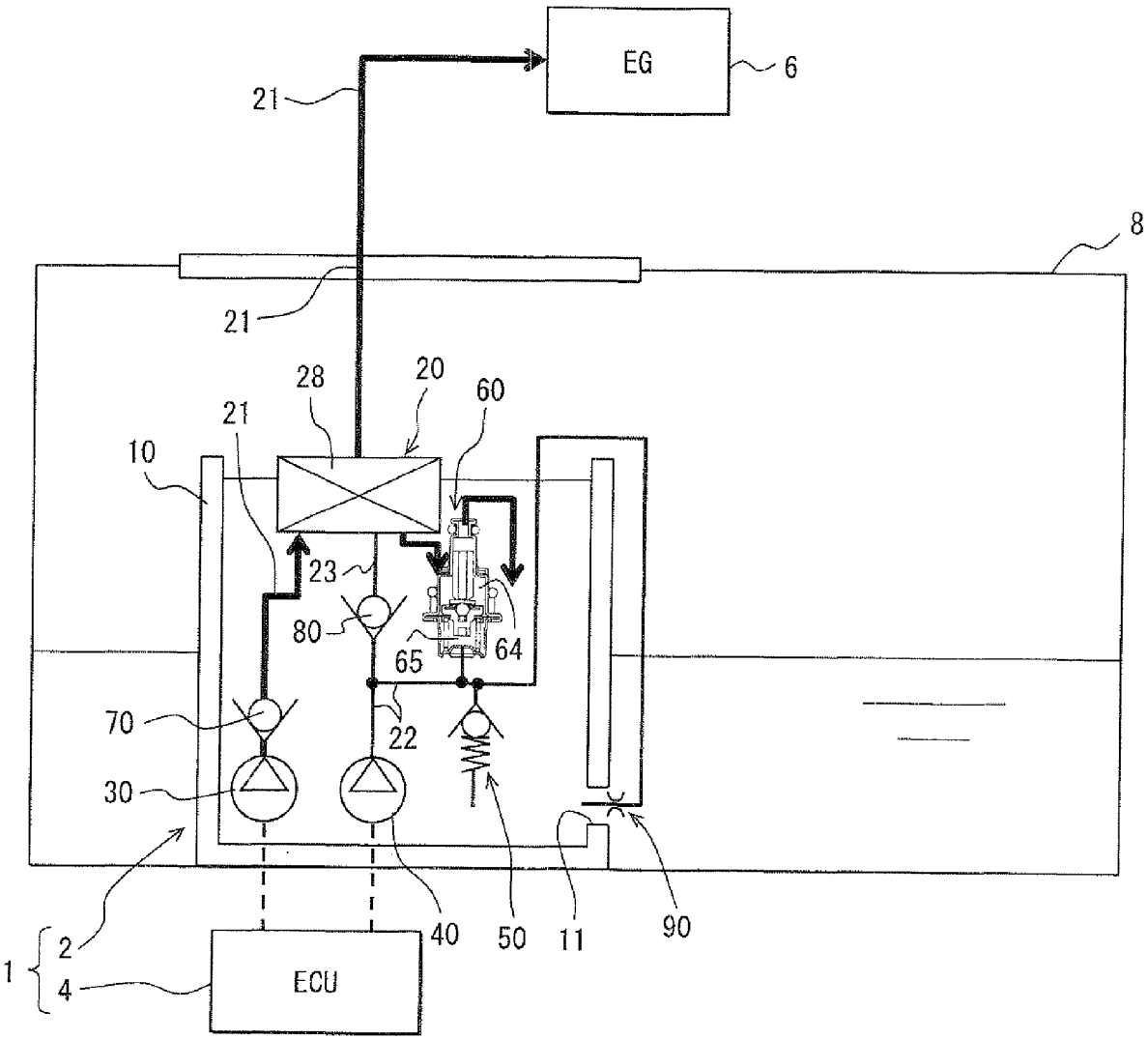
FIG. 5 is a schematic view illustrating a middle pressure mode of the fuel supply device.

A middle pressure mode is selected by the control unit 4 when the engine 6 has low or middle load at a normal driving time. As shown in FIG. 5, in the middle pressure mode, the control unit 4 controls voltage or current applied to the first pump 30 discharging fuel into the first passage 21. Therefore, the pressure of fuel discharged from the first pump 30 is made higher than the relief pressure Prl and the low regulation pressure Prg_l.

Further, the control unit 4 stops the second pump 40 by stopping electricity supply to the pump 40 discharging fuel into the second passage 22. In the middle pressure mode, the pressure of fuel discharged from the first pump 30 is flexibly controllable if the pressure is higher than the pressure Prl, Prg_l. In this embodiment, the pressure of fuel discharged from the first pump 30 is controlled to become lower than the high regulation pressure Prg_h, thereby consumption power can be reduced.

In this middle pressure mode, the fuel pressure of the second passage 22 is equal to the atmospheric pressure Pa lower than the relief pressure Prl, because the second pump 40 is stopped. At this time, as shown in a bold line arrow of FIG. 5, the relief valve 50 is closed. Further, the first check valve 70 is opened in the first passage 21 by the pressure of fuel discharged from the first pump 30.

As a result, a fuel pressure of the branch passage 23 adjacent to the first passage 21 becomes higher than a fuel pressure of the branch passage 23 adjacent to the second passage 22. Therefore, the first passage 21 is disconnected from the second passage 22, because the valve-opening conditions of the second check valve 80 are not satisfied.

Due to the pressure of fuel discharged from the first pump 30, the fuel pressure of the first passage 21 disconnected from the second passage 22 becomes higher than the low regulation pressure Prg_l, while the backpressure of the backpressure chamber 65 communicating with the second passage 22 is equal to the atmospheric pressure Pa. In this case, the fuel pressure of the fuel chamber 64 communicating with the first passage 21 becomes higher than the low regulation pressure Prg_l.

Therefore, the pressure regulator 60 discharges fuel from the fuel chamber 64 into the reservoir cup 10, as shown in the bold line arrow of FIG. 5. The fuel pressures of the fuel chamber 64 and the first passage 21 can be accurately controlled into the low regulation pressure Prg_l without being affected by accuracy for controlling the pressure of fuel discharged from the first pump 30. Thus, the low regulation pressure Prg_l correctly adjusted to be higher than the relief pressure Prl of the low pressure mode and to be lower than the high regulation pressure Prg_h of the high pressure mode will be given to the supply fuel supplied to the engine 6 by the first passage 21.

According to the first embodiment, the pressure of the supply fuel supplied to the engine 6 can be accurately controlled based on the operation state of the engine 6 by switching the control mode among the low pressure mode, the high pressure mode and the middle pressure mode. That is, at a high load operation time or a start time of the engine 6, the pressure of the supply fuel is raised into the high regulation pressure Prg_h. Therefore, fuel injected from the fuel injection valve can be made more minute, such that an output of the engine 6 can be made higher. Further, at a low or middle load operation time of the engine 6, the pressure of the supply fuel is lowered to the low regulation pressure Prg_l. Furthermore, at an idling operation time of the engine 6, the pressure of the supply fuel is sufficiently lowered to the relief pressure Prl. Thus, consumption power can be reduced.

The control unit 4 may correspond to a controller. The second check valve 80 may correspond to a check valve. The high regulation pressure Prg_h may correspond to a regulation pressure.

Second Embodiment

Figure 6:
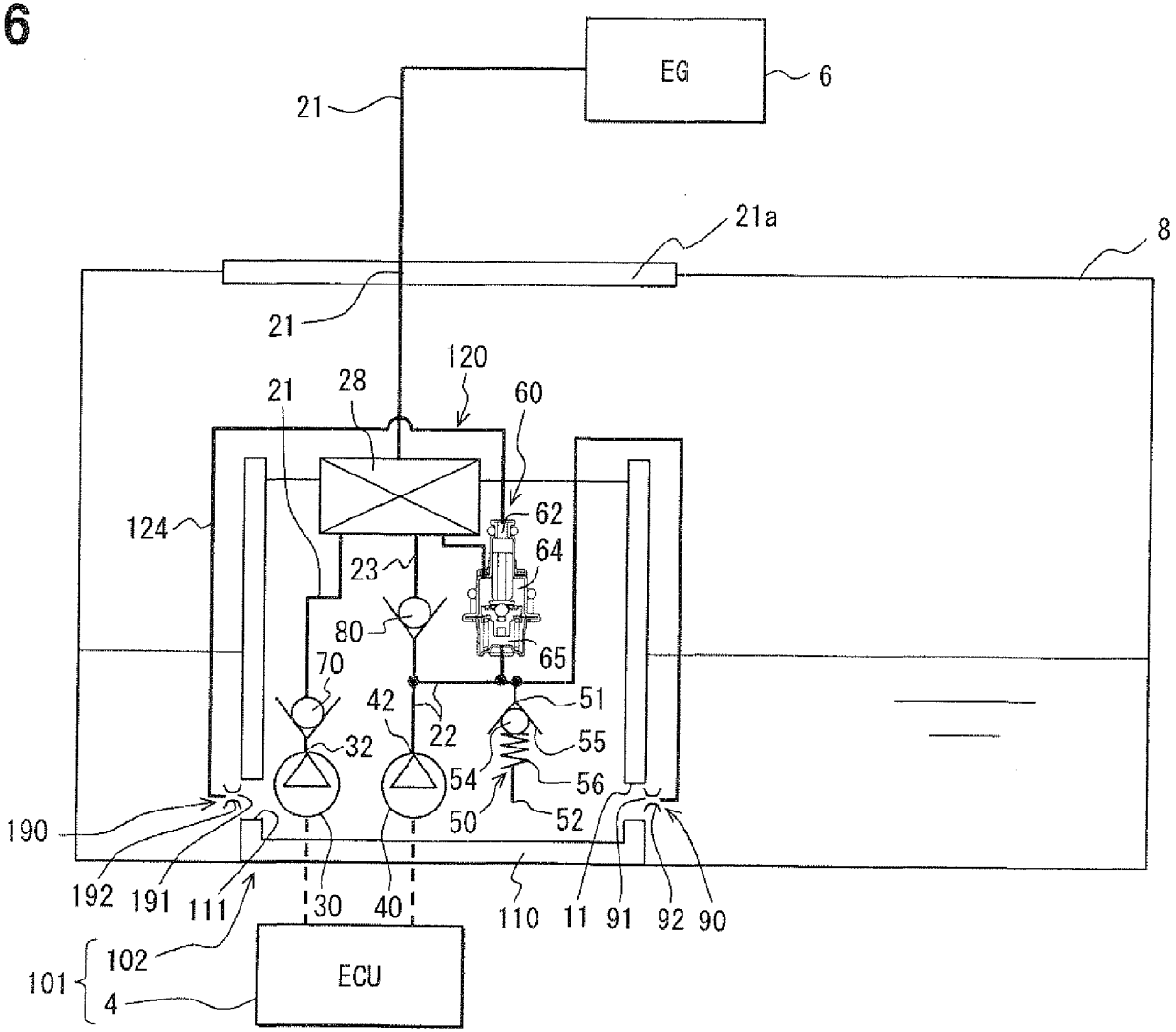
FIG. 6 is a schematic view illustrating a fuel supply device according to a second embodiment.

As shown in FIG. 6, a second embodiment of the present invention is a modification of the first embodiment, A fuel supply device 101 includes a pump unit 102 having a reservoir cup 110. A circumference wall of the reservoir cup 110 has a through hole 111 in addition to the through hole 11 of the first embodiment. The reservoir cup 110 is arranged inside of the fuel tank 8, and stores fuel flowing from the fuel tank 8 through the through holes 111, 11.

A fuel passage portion 120 of the pump unit 102 further has a discharge passage 124. The discharge passage 124 communicates with the discharge port 62 of the pressure regulator 60, and a downstream side of the discharge passage 124 extends outward from inside of the reservoir cup 110. The discharge passage 124 sends fuel from the fuel chamber 64 into adjacency of the through hole 111, in the high pressure mode and the middle pressure mode. The discharge passage 124 is made of the same passage member as the passage 21, 22, 23, for example.

The pump unit 102 further has a jet pump 190 in addition to the jet pump 90 of the first embodiment. The jet pump 190 is arranged at a downstream end of the discharge passage 124 outside of the reservoir cup 110. The jet pump 190 has an injection port 191 open toward the through hole 111 of the reservoir cup 110, and defines a throttle 192 to narrow a communication area of the discharge passage 124.

Due to the throttle 192 of the jet pump 190, a speed of fuel reaching the downstream end of the discharge passage 124 is made faster, and the fuel is injected toward the through hole 111 from the injection port 191. A negative pressure is generated in the through hole 111 by the fuel injection, and fuel stored in the fuel tank 8 is transported into the reservoir cup 110 through the through hole 111.

Figure 7:
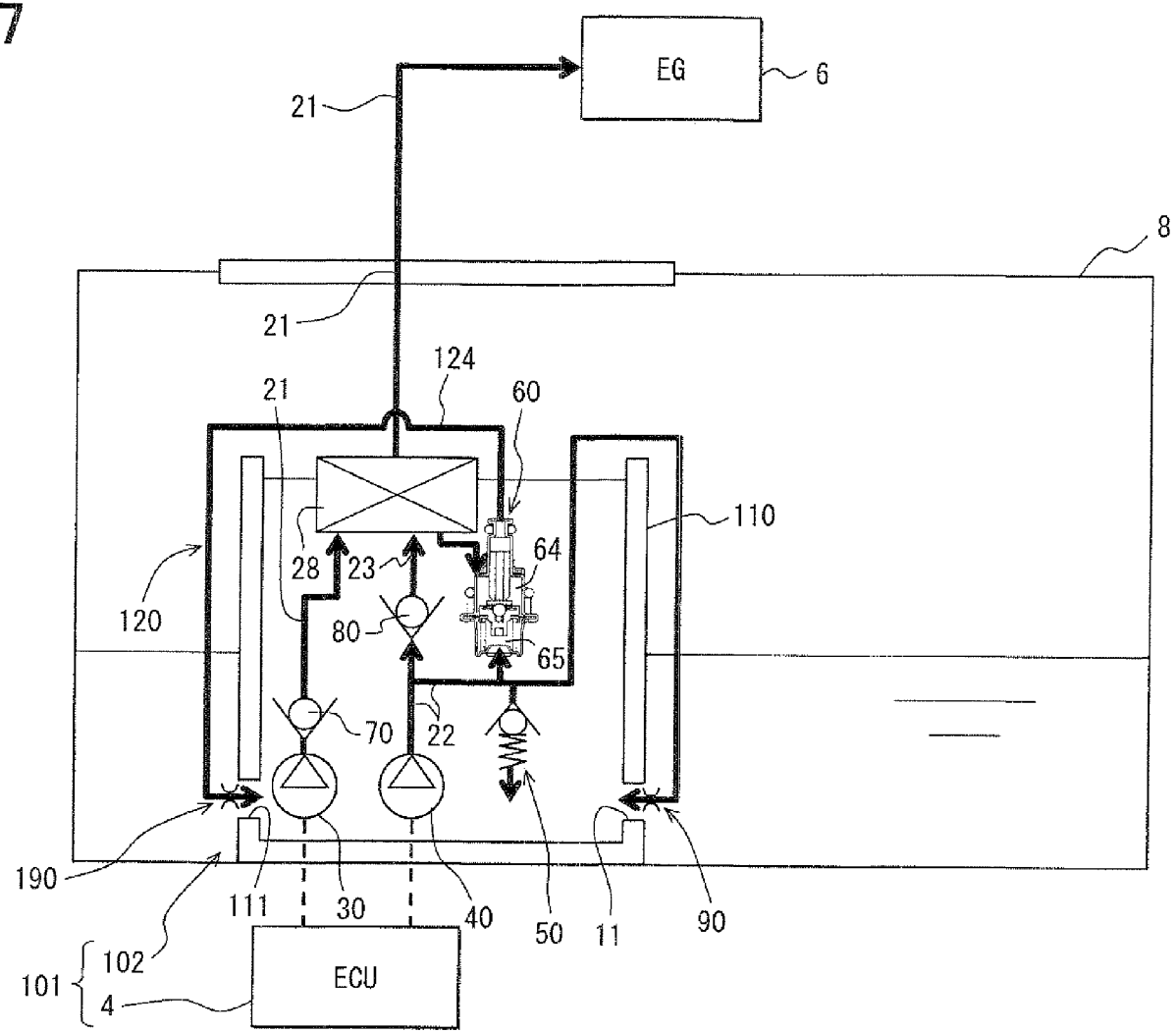
FIG. 7 is a schematic view illustrating a high pressure mode of the fuel supply device of the second embodiment.

As shown in a bold line arrow of FIG. 7, when the control unit 4 selects the high pressure mode in the second embodiment, the pressure regulator 60 discharges fuel from the fuel chamber 64 into the discharge passage 124. The fuel discharged into the discharge passage 124 is injected from the jet pump 190, thereby fuel stored in the fuel tank 8 is transported into the reservoir cup 110 through the through hole 111.

In the high pressure mode of the second embodiment, similar to the first embodiment, as shown in FIG. 7, fuel stored in the fuel tank 8 is transported into the reservoir cup 110 through the through hole 11. Therefore, even if both of the first pump 30 and the second pump 40 are operated in the high pressure mode, fuel is restricted from being shorted inside of the cup 110, and the pressure of fuel discharged from the pump 30, 40 can be restricted from becoming lower than the pressure Prg_h, Prl. Thus, due to the relief valve 50 and the pressure regulator 60, the fuel pressure of the passage 21, 22 can be properly controlled. Accordingly, the high regulation pressure Prg_h can be accurately secured as a pressure of the supply fuel in the high pressure mode.

Figure 8:
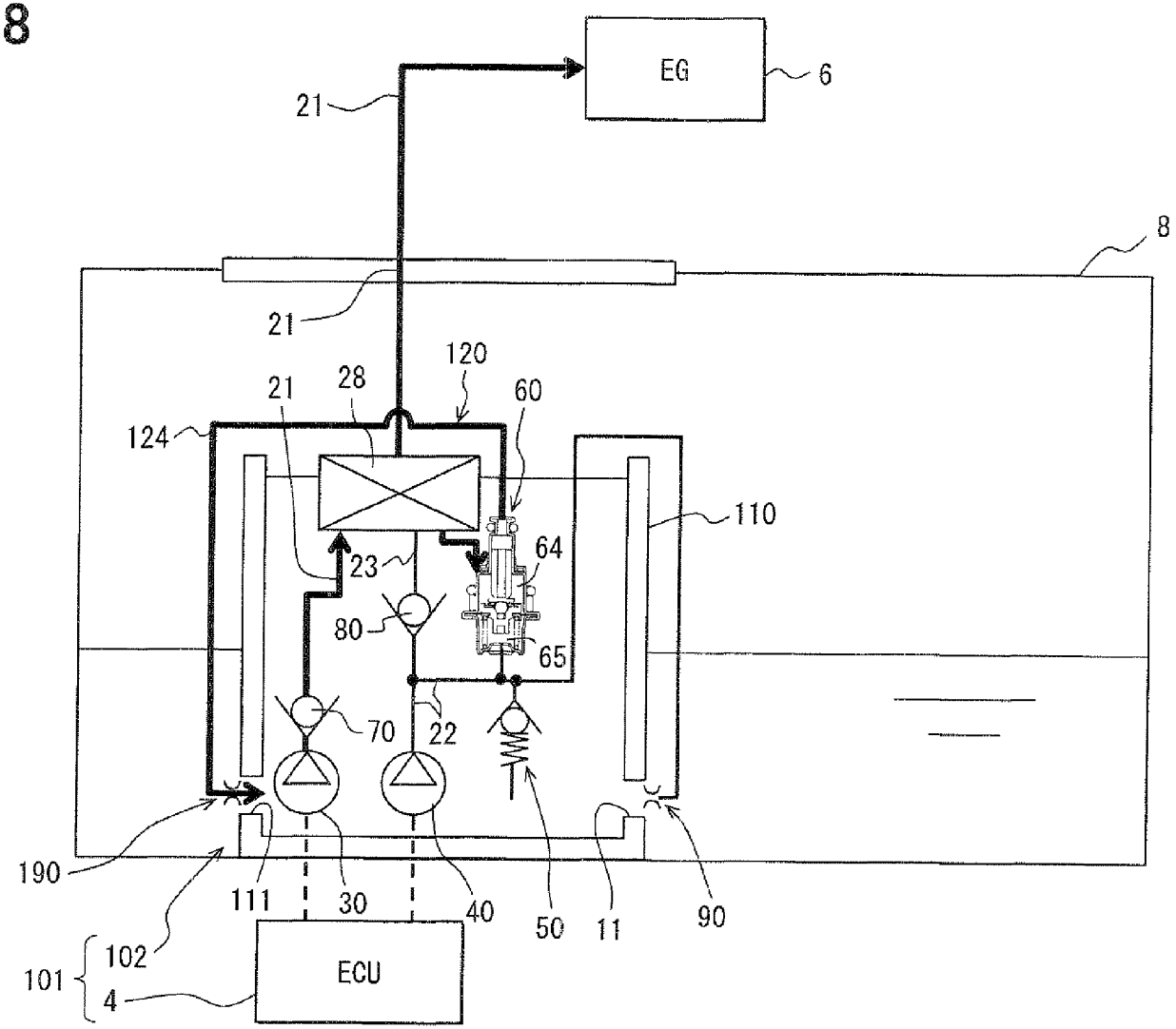
FIG. 8 is a schematic view illustrating a middle pressure mode of the fuel supply device of the second embodiment.

As shown in a bold line arrow of FIG. 8, when the control unit 4 selects the middle pressure mode in the second embodiment, the pressure regulator 60 discharges fuel from the fuel chamber 64 into the discharge passage 124. Similarly to the high pressure mode, the discharged fuel is injected from the jet pump 190, thereby fuel stored in the fuel tank 8 is transported into the reservoir cup 110 through the through hole 111.

Therefore, fuel to be suctioned by the first pump 30 can be restricted from being shorted inside of the cup 110. That is, the pressure of fuel discharged from the first pump 30 can be restricted from becoming lower than the low regulation pressure Prg_l. Thus, due to the relief valve 50 and the pressure regulator 60, the fuel pressure of the passage 21, 22 can be properly controlled. Accordingly, the low regulation pressure Prg_l can be accurately secured as a pressure of the supply fuel in the middle pressure mode.

Other Embodiment

The present invention is not limited to the above embodiments, and the above embodiment may be modified within a scope of the present invention.

For example, a specification of the electric pump 30, 40 may be modified, as long as operation and effect of the present invention is acquired. Moreover, the middle pressure mode may not be selected by the control unit 4.

The pressure of fuel discharged from the second pump 40 in the low pressure mode may be set higher than the low regulation pressure Prg_l or the high regulation pressure Prg_h.

The pressure of fuel discharged from the second pump 40 in the high pressure mode may be set higher than the low regulation pressure Prg_l, and may be set lower than the high regulation pressure Prg_h.

Such changes and modifications are to be understood as being within the scope of the present invention as defined by the appended claims.

What is claimed is:

1. A fuel supply device to supply fuel to an engine comprising:

a fuel passage portion having a first passage to send supply fuel to the engine, and a second passage to communicate with the first passage;

a first electric pump to send fuel into the first passage;

a second electric pump to send fuel into the second passage;

a relief valve to discharge fuel from the second passage when a fuel pressure of the second passage is higher than a predetermined relief pressure;

a pressure regulator having a fuel chamber to communicate with the first passage, and a backpressure chamber to communicate with the second passage; and a controller to switch control mode of the first pump and the second pump between a low pressure mode and a high pressure mode based on an operation state of the engine, wherein the pressure regulator discharges fuel from the fuel chamber when a fuel pressure of the fuel chamber is higher than a regulation pressure in a state that a fuel pressure of the backpressure chamber is equal to the relief pressure, the regulation pressure being higher than the relief pressure, the controller controls the first pump to stop, and controls a pressure of fuel discharged from the second pump to become higher than the relief pressure, when the low pressure mode is selected, and the controller controls a pressure of fuel discharged from the first pump to become higher than the regulation pressure, and controls a pressure of fuel discharged from the second pump to become higher than the relief pressure, when the high pressure mode is selected.

2. The fuel supply device according to claim 1, further comprising:

a check valve to disconnect the first passage from the second passage when the fuel pressure of the first passage becomes higher than the fuel pressure of the second passage.

3. The fuel supply device according to claim 1, wherein the pressure regulator discharges fuel from the fuel chamber when a fuel pressure of the fuel chamber becomes higher than a low regulation pressure in a state that a fuel pressure of the backpressure chamber is lower than the relief pressure, the low regulation pressure being higher than the relief pressure and being lower than a high regulation pressure corresponding to the regulation pressure, the control mode switched by the controller further has a middle pressure mode other than the low pressure mode and the high pressure mode, and the controller controls the pressure of fuel discharged from the first pump to become higher than the low regulation pressure, and controls the second pump to stop, when the middle pressure mode is selected.

4. The fuel supply device according to claim 3, further comprising:

a check valve to disconnect the first passage from the second passage when the fuel pressure of the first passage becomes higher than the fuel pressure of the second passage.

5. The fuel supply device according to claim 1, further comprising: a reservoir cup arranged in a fuel tank of the engine so as to store fuel to be suctioned by the first pump or the second pump; and a jet pump to send fuel from the fuel tank into the reservoir cup by injecting fuel flowing through the second passage.

6. The fuel supply device according to claim 1, further comprising:

a reservoir cup arranged in a fuel tank of the engine so as to store fuel to be suctioned by the first pump or the second pump; and a jet pump to send fuel from the fuel tank into the reservoir cup by injecting fuel discharged from the fuel chamber through the pressure regulator.

* * * * *